US010760279B2

(12) United States Patent
Jang

(10) Patent No.: US 10,760,279 B2
(45) Date of Patent: Sep. 1, 2020

(54) CORRUGATED PLATE FOR VENTILATING AND DISSIPATING HEAT FROM A ROOF

(71) Applicant: Kuan-Chih Jang, Kaohsiung (TW)

(72) Inventor: Kuan-Chih Jang, Kaohsiung (TW)

( * ) Notice: Subject to any disclaimer, the term of this patent is extended or adjusted under 35 U.S.C. 154(b) by 0 days.

(21) Appl. No.: 16/554,857

(22) Filed: Aug. 29, 2019

(65) Prior Publication Data

US 2020/0190810 A1 Jun. 18, 2020

(30) Foreign Application Priority Data

Dec. 18, 2018 (TW) ..... 107145720 A

(51) Int. Cl.
*E04D 13/17* (2006.01)
*F24F 7/02* (2006.01)

(52) U.S. Cl.
CPC ..... *E04D 13/17* (2013.01); *F24F 7/02* (2013.01)

(58) Field of Classification Search
CPC ..... E04D 13/17; E04D 13/172; E04D 13/174; E04D 13/178; E04D 13/1687; E04D 13/1681; F24F 7/02
USPC ..... 52/57, 198, 302.1, 302.3, 302.4
See application file for complete search history.

(56) References Cited

U.S. PATENT DOCUMENTS 4,251,967 A 2/1981 Hoofe, III
5,636,481 A * 6/1997 De Zen ..... E04B 7/205 52/95
5,651,226 A 7/1997 Archibald
6,415,559 B1 * 7/2002 Reeves ..... E04D 13/00 52/302.3
2013/0167833 A1 * 7/2013 Daniels ..... E04D 13/174 126/621
2015/0253021 A1 * 9/2015 Daniels ..... F24F 13/32 454/341
2019/0030382 A1 * 1/2019 Roussos ..... F24C 15/2035

FOREIGN PATENT DOCUMENTS

GB 2181470 A * 4/1987 ..... E04D 13/17
GB 2239031 A * 6/1991 ..... E04D 13/008
TW M577039 U 4/2019
WO 9831894 A1 7/1998
WO 0133009 A1 5/2001

OTHER PUBLICATIONS

Taiwan Patent Office, "Search Report appended to an Office Action," which was issued to Taiwanese counterpart application No. 107145720 dated Nov. 21, 2019, document of 2 pages.

* cited by examiner

*Primary Examiner* — Brent W Herring
(74) *Attorney, Agent, or Firm* — Akerman LLP; Peter A. Chiabotti

(57) ABSTRACT

A corrugated plate assembly includes at least two corrugated plates each having a crest portion. The crest portion is asymmetric and includes first and second arcuate ends, two longitudinal lateral sides connected between the first and second arcuate ends and two indentations indented from the first and second arcuate ends. The second arcuate ends of the corrugated plates are interconnected in such a manner that the indentations of the second arcuate ends are intersected each other and that the second arcuate ends overlap with each other. Ventilation gaps are formed between overlapping parts of the second arcuate ends.

15 Claims, 8 Drawing Sheets

CORRUGATED PLATE FOR VENTILATING AND DISSIPATING HEAT FROM A ROOF

CROSS-REFERENCE TO RELATED APPLICATION

This application claims priority to Taiwanese Patent Application No. 107145720, filed on Dec. 18, 2018.

FIELD

The disclosure relates to a corrugated plate, and more particularly to a corrugated plate for ventilating and dissipating heat from a roof.

BACKGROUND

Conventional iron roofs easily absorb heat and thus tend to increase an indoor temperature. Roofs made by overlapping tiles generally have a heat insulating effect. However, the tiles have to be fixed with each other by cement or glue. Fixing the tiles is troublesome and requires to rely on experienced and skilled persons. Further, because the tiles with same shape are overlapped with each other, it is difficult to form ventilation gaps among the tiles.

FIG. 1 shows a plurality of conventional corrugated plates 1 each of which includes a bottom plate 11 elongated along a longitudinal direction (D), two side plates 12 extending upwardly and respectively from two opposite sides of the bottom plate 11, and a cover plate 13 connected between the side plates 12. The bottom plate 11, the side plates 12 and the cover plate 13 cooperatively define a ventilation path 100. The cover plate 13 has a crest portion 130, a hooked portion 131 connected to one of two opposite sides of the crest portion 130, and a connection portion 132 connected to the other one of the two opposite sides of the crest portion 130. The corrugated plate 1 is made from a plastic material. Multiple corrugated plates 1 can be interconnected with each other by overlapping the hook portion 131 of each of the corrugated plates 1 with the connection portions 132 of the other one of the corrugated plates 1 to form a roof. The roof thus formed provides not only ventilation through the ventilation paths 100, but also insulation through the insulating properties of the plastic corrugated plates 1.

However, because each corrugated plate 1 has a single ventilation path 100, the ventilating effect may be insufficient for a region where the airflow direction is unstable. On the other hand, two adjacent corrugated plates 1 cannot be fixed together by simply overlapping the hook and connection portions 131, 132 thereof. Fasteners, such as bolts or rivets, are required to secure the corrugated plates 1 together, thereby increasing complexity of assembling the corrugated plates 1.

SUMMARY

Therefore, an object of the disclosure is to provide a corrugated plate for ventilating and insulating heat from a roof, which can alleviate at least one of the drawbacks of the prior art.

According to the disclosure, a corrugated plate, which is suitable for ventilating and dissipating heat from a roof, includes a crest portion, a first trough portion, a second trough portion and two curved rise portions.

The crest portion is elongated along and curved around a longitudinal line. The crest portion includes an arcuate part that has a first arcuate end, a second arcuate end, two longitudinal lateral sides and two indentations. The second arcuate end is opposite to the first arcuate end along the longitudinal line. The longitudinal lateral sides are opposite to each other and connected between the first and second arcuate ends. The indentations are respectively indented from the first and second arcuate ends. The arcuate part has a curvature that is asymmetric with respect to a central plane which is parallel to the longitudinal line (L) and which intersects the arcuate part at a middle of said arcuate part.

The first trough portion extends longitudinally and is connected to one of the longitudinal lateral sides.

The second trough portion extends longitudinally and is connected to the other one of the longitudinal lateral sides.

The curved rise portions extend longitudinally and are respectively connected to the first and second trough portions oppositely of the crest portion.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
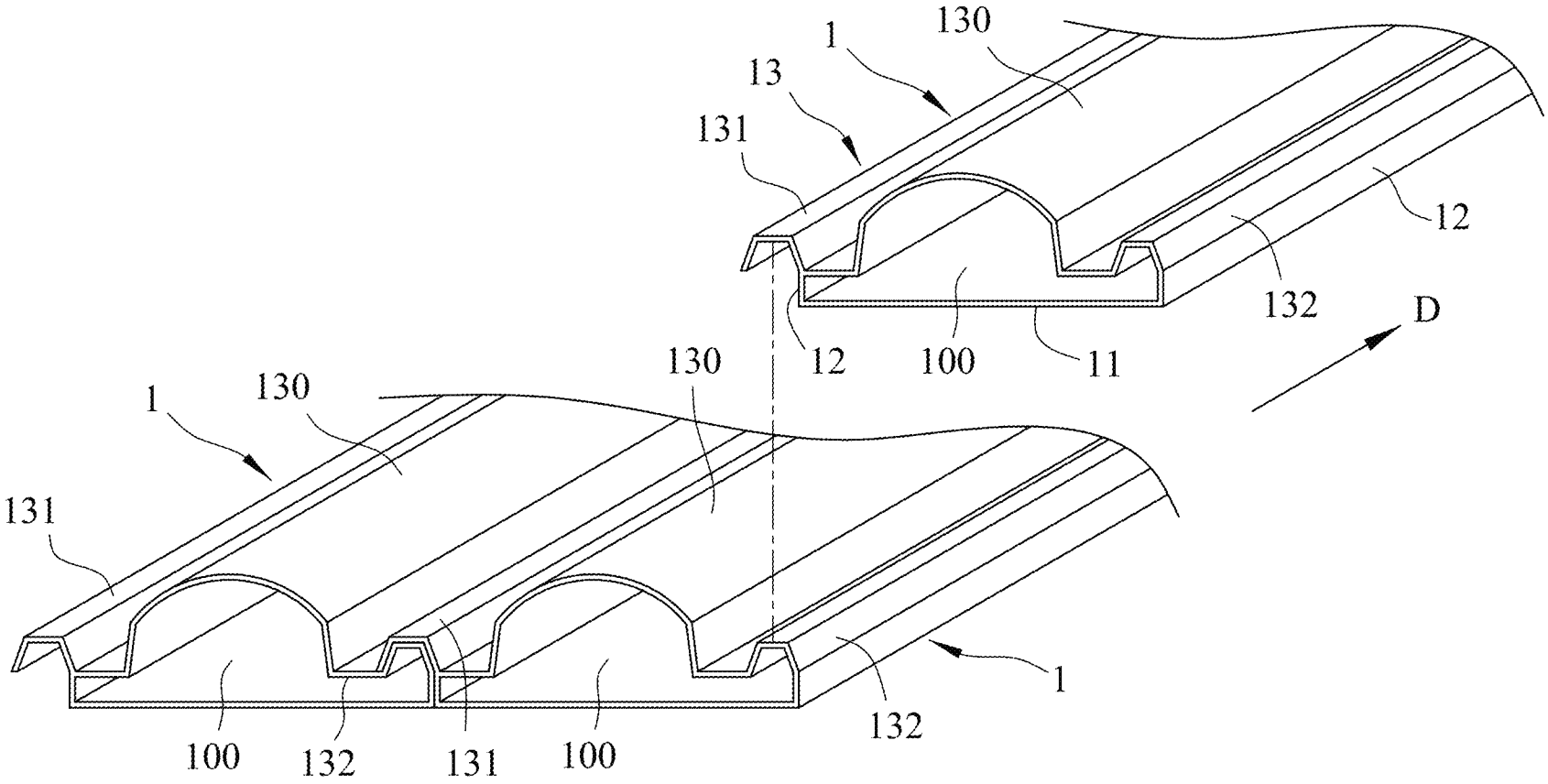
FIG.1 PRIOR ART
FIG. 1 is a fragmentary perspective view illustrating multiple existing corrugated plates overlapping with each other to form a roof.
Figure 2:
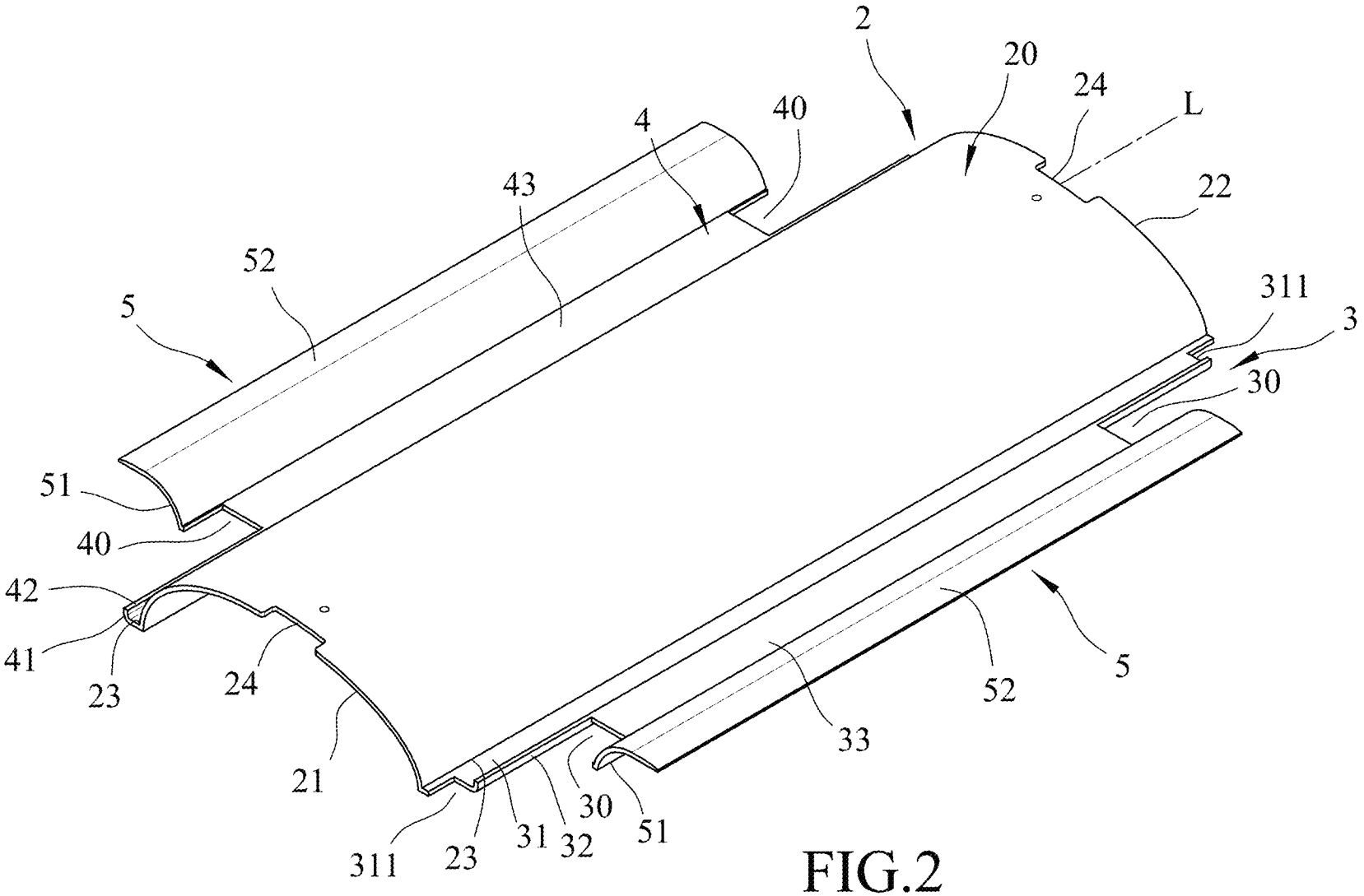
FIG. 2 is a perspective view illustrating an embodiment of a corrugated plate according to the disclosure.

FIG. 2 illustrates an embodiment of a corrugated plate for ventilation and dissipation heat from a roof according to the disclosure. The corrugated plate includes a crest portion 2, a first trough portion 3, a second trough portion 4 and two curved rise portions 5. For assembling a ventilating and insulating structure, a plurality of corrugated plates are to be interconnected in association with a plurality of hollow bricks 9 (see FIG. 6).

Figure 3:
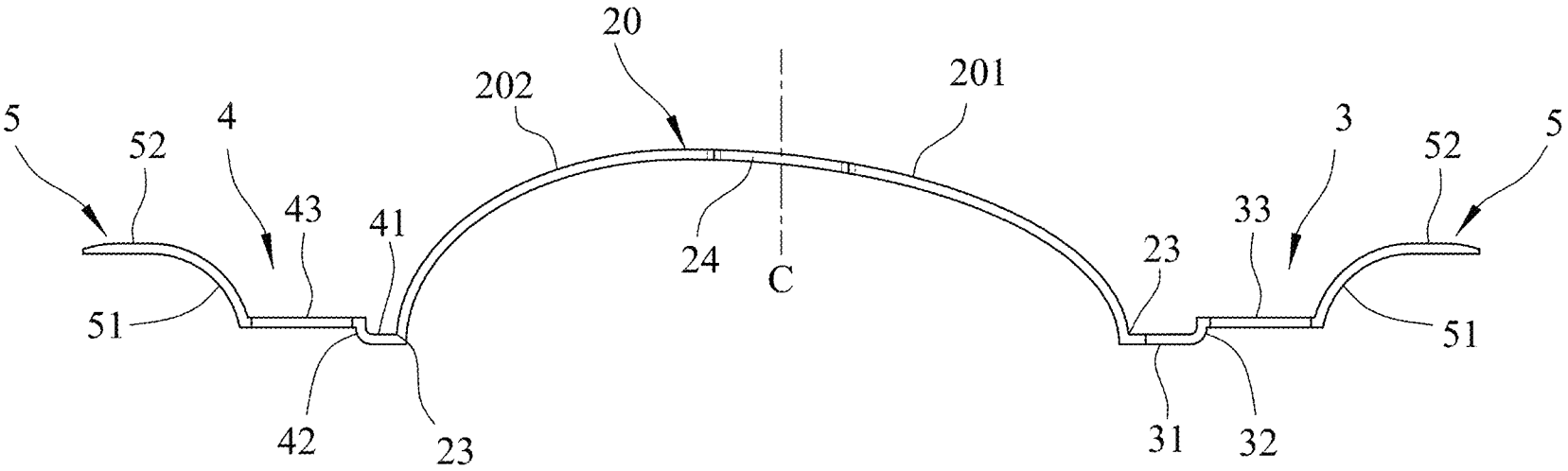
FIG. 3 is a front view of the embodiment.

As shown in FIGS. 2 and 3, the crest portion 2 includes an arcuate part. 20 that is elongate along and curved around the Longitudinal line (L). The arcuate part 2 has a first arcuate end 21, a second arcuate end 22, two longitudinal lateral sides 23 and two indentations 24. The second arcuate end 22 is opposite to the first arcuate end 21 along the longitudinal line (L). The longitudinal lateral sides 23 are opposite to each other and are connected between the first and second arcuate ends 21, 22. The indentations 24 are respectively indented from the first and second arcuate ends 21, 22. The arcuate part 20 has a curvature that is asymmetric with respect to a central plane (C) which is parallel to the longitudinal line (L) and which intersects the arcuate part 20 at a middle of the arcuate part 20. In this embodiment, the arcuate part 20 has a first half 201 and a second half 202 respectively disposed on two opposite sides of the central plane (C). The first half 201 has a radius of curvature greater than that of the second half 202. The central plane (C) passes through both of the indentations 24.

The first trough portion 3 extends longitudinally and adjoins the first half 201 by being connected to one of the longitudinal lateral sides 23. The first trough portion 3 has a first seat segment 31 adjoining one of the longitudinal lateral sides 23, a first bent segment 32 bent from the first seat segment 31 and extending away from one of the longitudinal lateral sections 23 which is adjacent thereto, and a first stair segment 33 adjoining the first bent segment 32 and extending away from one of the longitudinal lateral sides 23, which is adjacent thereto. The first seat segment 31 and the first stair segment 33 have a differential height therebetween. The first seat segment 31 has longitudinally opposite first and second ends partially and respectively flush with the first and second arcuate ends 21, 22 of the arcuate part 20, and two cutouts 311 respectively formed in the longitudinally opposite first and second ends of the first seat segment 31.

The second trough portion 4 extends longitudinally and adjoins the second half 202 by being connected to the other one of the longitudinal lateral sides 23. The second trough portion 4 has a second seat segment 41 adjoining the other one of the longitudinal lateral sides 23 and having longitudinally opposite first and second ends which are respectively flush with the first and second arcuate ends 21, 22 of the arcuate part 20, a second bent segment 42 adjoining the second seat segment 41 and extending away from the other one of the longitudinal lateral sides 23, and a second stair segment 43 adjoining the second bent segment 42 and extending away from the other one of the longitudinal lateral sides 23. The second seat segment 41 and the second stair segment 43 have a differential height therebetween.

The curved rise portions 5 extend longitudinally and are respectively connected to the first and second trough portions 3, 4 oppositely of the crest portion 2. Each of the curved rise portions 5 has an inner curved segment 51 adjoining one of the first and second trough portions 3, 4, and an outer flat segment 52 adjoining the inner curved segment 51 and extending away oppositely of the crest portion 2.

In this embodiment, as shown in FIG. 2, each of the curved rise portions 5 has longitudinally opposite first and second ends which are indented respectively from imaginary planes respectively lying across the first and second arcuate ends 21, 22 of the arcuate part 20. The first bent segment 32 has longitudinally opposite first and second ends respectively proximal to the first and second ends of the first seat segment 31. The first stair segment 33 has longitudinally opposite first and second ends which are indented respectively from the first and second ends of the first bent segment 32 and which are also indented respectively from the first and second ends of an adjacent one of the curved rise portions 5. Accordingly, there are two cutouts 30 immediately and respectively adjacent to the first and second ends of the first stair segment 33. Further, the second bent segment 42 has longitudinally opposite first and second ends respectively proximal to the first and second ends of the second seat segment 41. The second stair segment 43 has longitudinally opposite first and second ends which are indented respectively from the first and second ends of the second bent segment 42 and which are also indented respectively from the first and second ends of the other one of the curved rise portions 5. Accordingly, there are two cutouts 40 immediately and respectively adjacent to the first and second ends of the second stair segment 43.

Figure 4:
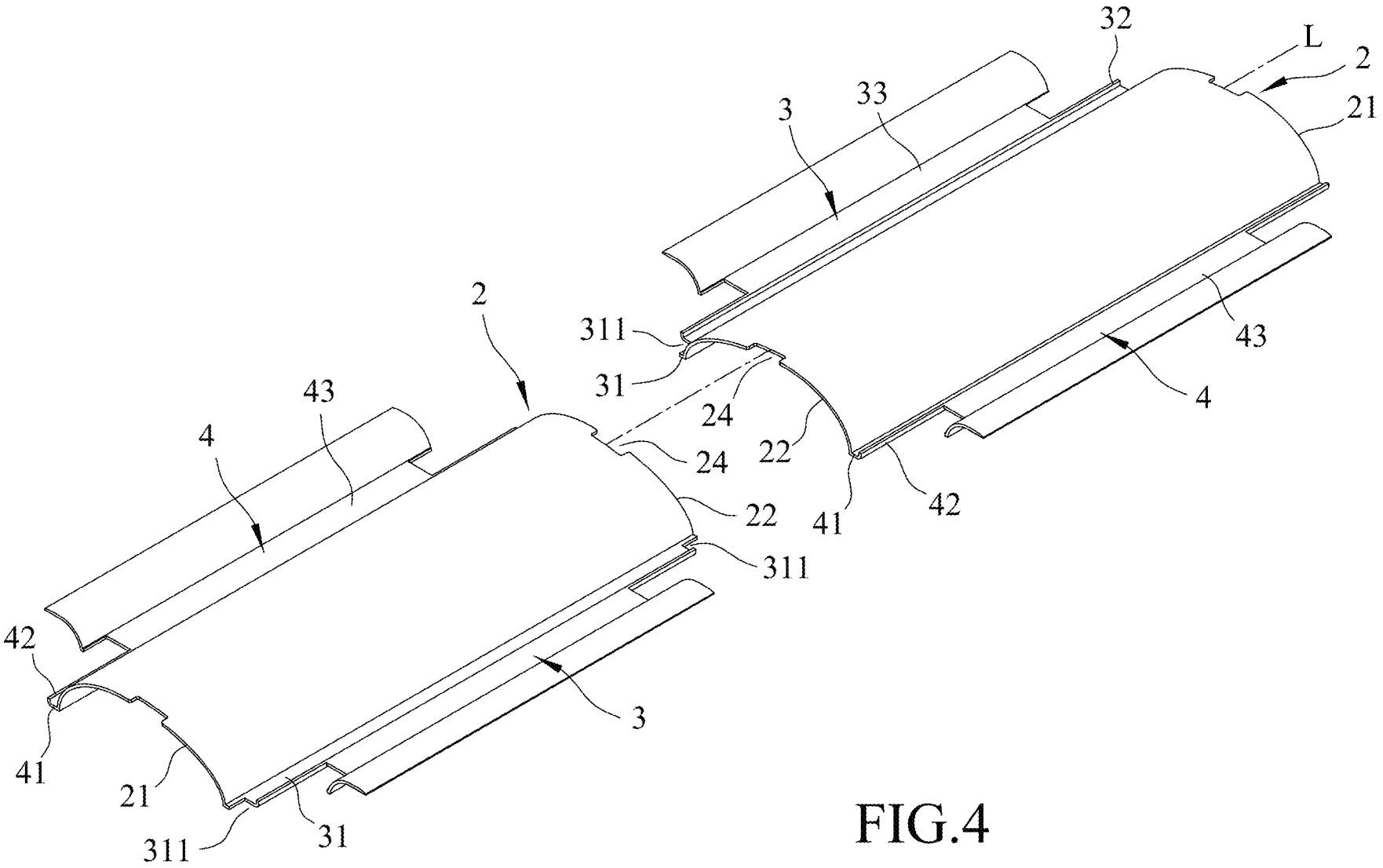
FIG. 4 is an exploded perspective view of the embodiment illustrating two corrugated plates being aligned to face each other.
Figure 5:
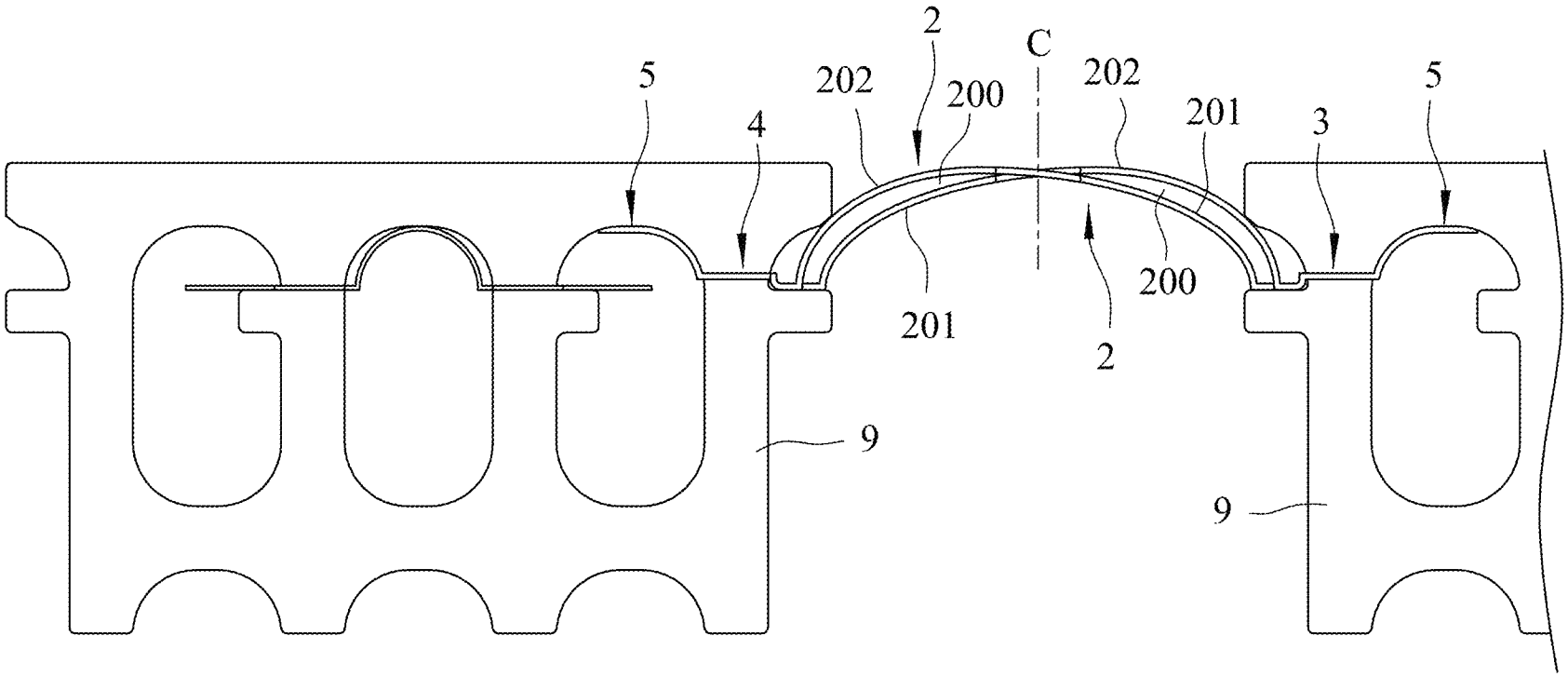
FIG. 5 is a front view illustrating the two corrugated plates shown in FIG. 4, which are assembled with two hollow bricks to form a ventilating and insulating structure for a roof.

Referring to FIGS. 4 and 5, two corrugated plates of the disclosure are assembled together by coupling with two hollow bricks 9. The second arcuate ends 22 of the two corrugated plates are aligned to face each other along the longitudinal line (L) and are interconnected in such a manner that the indentations 24 of the second arcuate ends 22 are intersected each other and that the second arcuate ends 22 overlap with each other on two opposite sides of the indentations 24. The second ends of the first and second seat segments 31, 41 of one of the two corrugate plates respectively overlap the second ends of the second and first seat segments 41, 31 of the other one of the two corrugate plates. The cutout 311 formed in the second end of the first seat segment 31 of one of the two corrugated plates receives the second end of the second seat segment 41 of the other one of the two corrugated plates, thereby stabilizing the connection of the second arcuate ends 22 of the two corrugated plates.

Because the curvature of the arcuate part 20 is asymmetric, when the arcuate part 20 is viewed from the first and second arcuate ends 21, 22, the curvature of the arcuate part presents two different shapes which form a mirror image of each other. Therefore, when the second arcuate end 22 of the two corrugated plates are placed face to face each other, the arcuate parts 20 of the two corrugated plates are staggered, and ventilation gaps 200 (FIGS. 5, 8) are formed between overlapping parts of the second arcuate ends 22 on two opposite sides of the center plane (C). By virtue of the ventilation gaps 200, longitudinal ventilation channels are formed along the longitudinal line (L).

Figure 6:
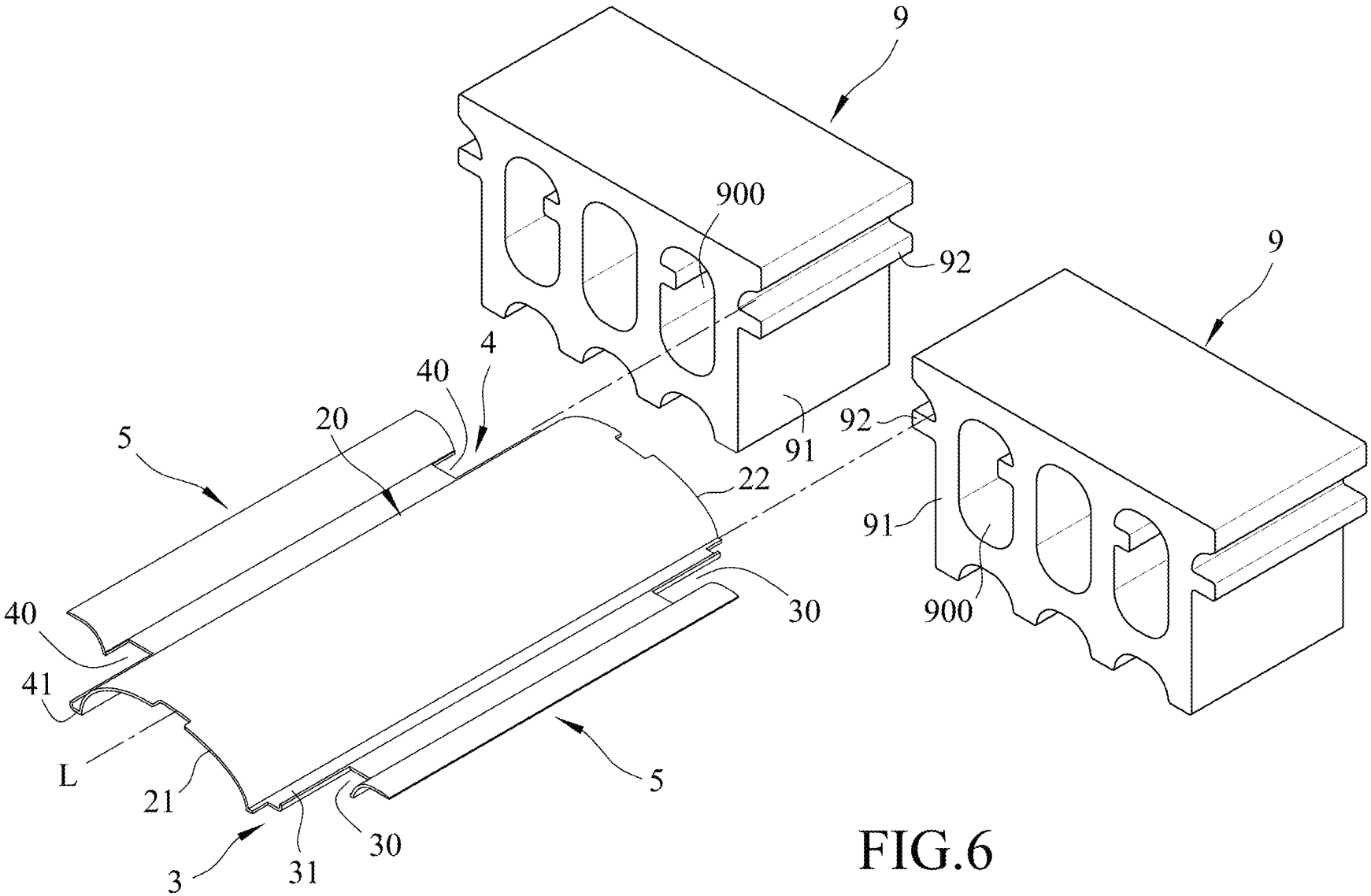
FIG. 6 is an exploded view illustrating one corrugated plate and two hollow bricks.
Figure 7:
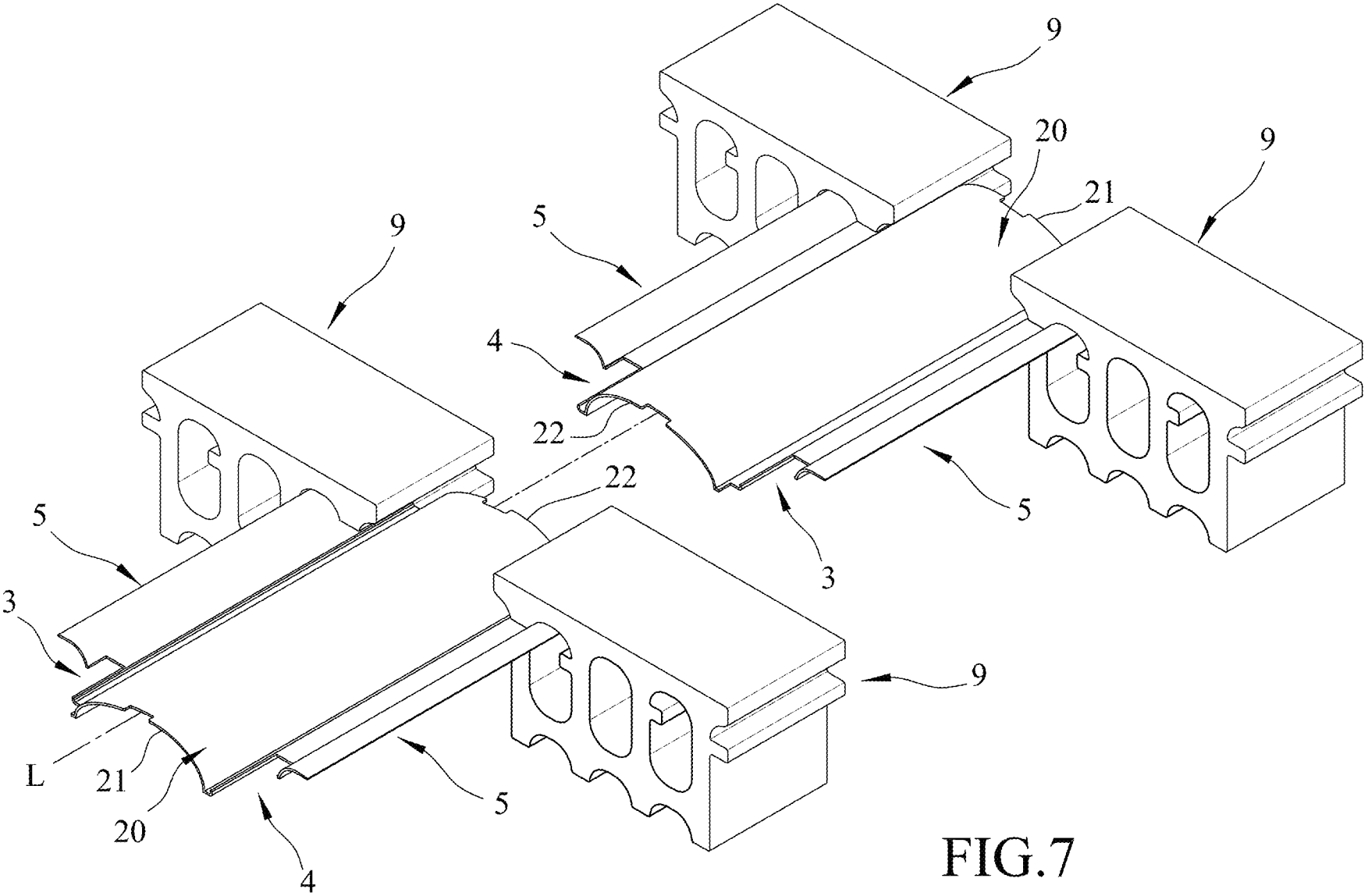
FIG. 7 is an exploded view illustrating two corrugated plates assembled with four hollow bricks.

As shown in FIGS. 6 and 7, a plurality of hollow bricks 9 are assembled with the corrugate plates in a manner that the second arcuate ends 22 of the two corrugated plates are aligned to face each other along the longitudinal line (L). Each of the hollow bricks 9 has two opposite side walls 91, two outer holding ribs 92 projecting respectively from outer surfaces of the side walls 3 in opposite outward directions, and a plurality of ventilation holes 900 bounded by the side walls 91. The cutouts 30 and 40 adjacent to the second arcuate ends 22 of the corrugate plates respectively receive or engage the side walls 91 of two adjacent hollow bricks 9 disposed transversely to the longitudinal line (L). The second ends of the first and second seat segments 31, 41 of the corrugated plates are supported by the outer holding ribs 92 of the adjacent hollow bricks 9. The curve rise portions 5 of the corrugated plates are inserted into the ventilation holes 900 and extend upwardly to abut top surfaces of the ventilation holes 900 of the adjacent hollow bricks 9. Because the first and second trough portions 3, 4 of the corrugated plates are supported by the outer holding ribs 92 of the adjacent hollow bricks 9, the corrugated plates are ensured to be positioned between the adjacent hollow bricks 9. By associating with a plurality of the hollow bricks 9, the corrugated plates can be arranged in rows and formed into a ventilation and temperature-adjustment structure on the roof.

It is worthy to note that cementing, gluing and nailing processes are not necessary during assembling of the corrugated plates. Also, bolts or rivets are not required for fixing purposes. Through the resiliency of the plastic material and the interlockable parts of the corrugated plates of the disclosure, the corrugated plates can be assembled without using any assisting tool.

Figure 8:
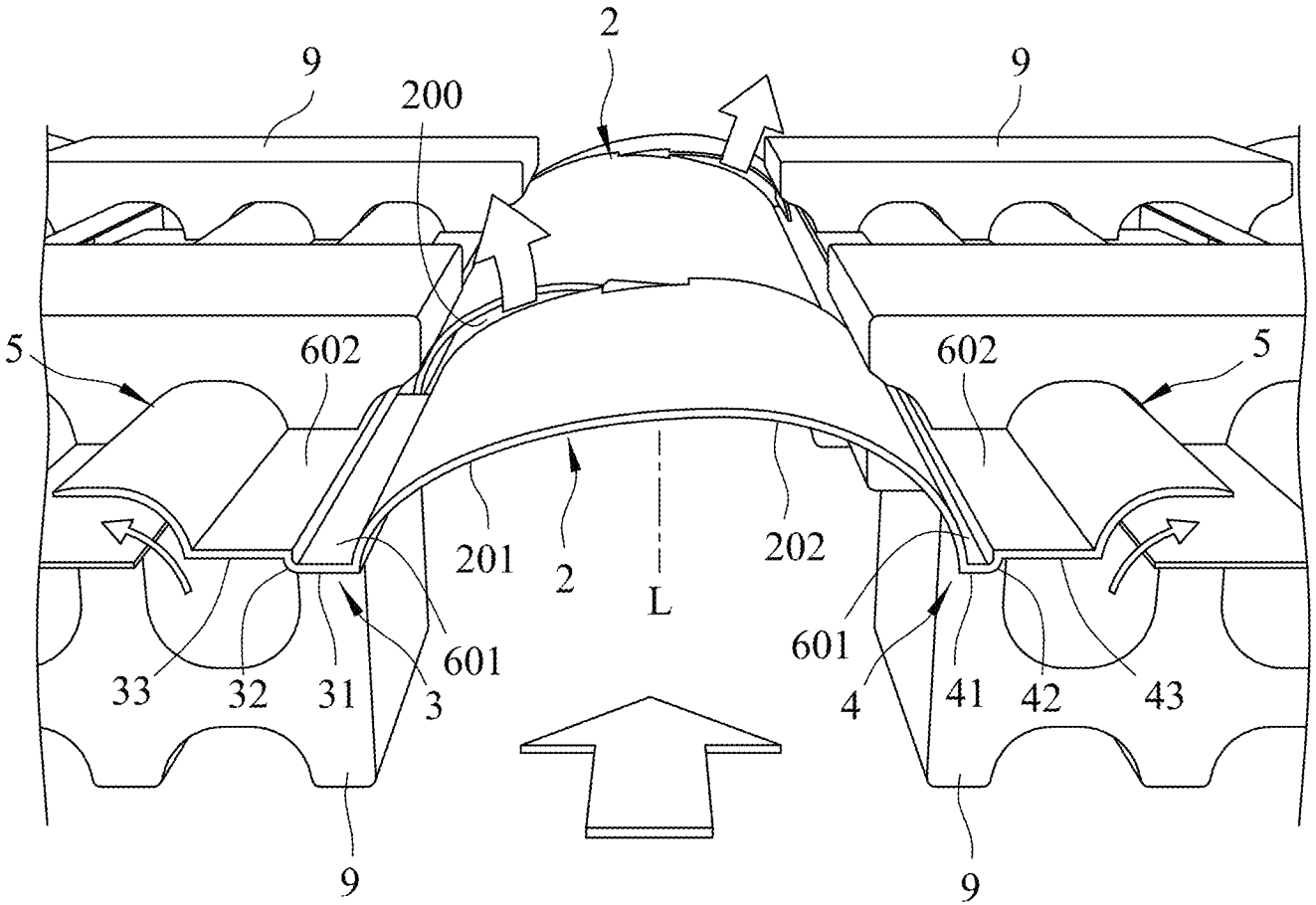
FIG. 8 is a fragmentary perspective view illustrating ventilation paths of the assembly of two corrugated plates and four hollow bricks shown in FIG. 7.

Referring to FIG. 8, in combination with FIG. 7, the assembly formed from the corrugated plates and the hollow bricks 9 has a drainage mechanism formed by the first and second trough portions 3, 4 of the corrugated plates. Water flowing down from the crest portions 2 to the first and second trough portions 3, 4 can be drained through two drainage channels 601 formed by the first and second seat segments 31, 41. When the water accumulated in the first and second seat segments 41 rises to the first and second stair segments 33, 43, because the curved rise portions 5 are curved upwardly from the first and second stair segments 33, 43, the water will be drained through two second drainage channels 602 formed by the first and second stair segments 33, 43.

Because the curved rise portions 5 are curved upwardly from the first and second trough portions 3, 4, additional ventilation paths can be formed below the curved rise portions 5 (see FIG. 8). Multiple air paths can thus be formed to enhance heat dissipating and insulating effects.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A corrugated plate for ventilating and dissipating heat from a roof, comprising:

a crest portion elongated along and curved around a longitudinal line, said crest portion including an arcuate part that has a first arcuate end, a second arcuate end opposite to said first arcuate end along the longitudinal line, two longitudinal lateral sides opposite to each other and connected between said first and second arcuate ends, and two indentations respectively indented from said first and second arcuate ends, wherein said arcuate part has a curvature that is asymmetric with respect to a central plane which is parallel to the longitudinal line and which intersects said arcuate part at a middle of said arcuate part;

a first trough portion extending longitudinally and connected to one of said lateral sides;

a second trough portion extending longitudinally and connected to the other one of said lateral sides; and two curved rise portions extending longitudinally and respectively connected to said first and second trough portions oppositely of said crest portion.

2. The corrugated plate as claimed in claim 1, wherein said central plane passes through both of said indentations.

3. The corrugated plate as claimed in claim 1, wherein said arcuate part further has a first half and a second half respectively disposed on two opposite sides of the central plane, said first half having a radius of curvature greater than that of said second half.

4. The corrugated plate as claimed in claim 3, wherein said first trough portion adjoins said first half, and said second trough portion adjoins said second half.

5. The corrugated plate as claimed in claim 1, wherein said first trough portion has a first seat segment adjoining said one of said longitudinal lateral sides, a first bent segment bent from said first seat segment and extending away from said one of said longitudinal lateral sections, and a first stair segment adjoining said first bent segment and extending away from said one of said longitudinal lateral sides, said first seat segment and said first stair segment having a differential height therebetween.

6. The corrugated plate as claimed in claim 5, wherein each of said curved rise portions has longitudinally opposite first and second ends which are indented respectively from imaginary planes respectively lying across said first and second arcuate ends of said arcuate part, said first bent segment having longitudinally opposite first and second ends respectively proximal to said first and second ends of said first seat segment, said first stair segment having longitudinally opposite first and second ends which are indented respectively from said first and second ends of said first bent segment and which are also indented respectively from said first and second ends of one of said curved rise portions.

7. The corrugated plate as claimed in claim 5, wherein said second trough portion has a second seat segment adjoining the other one of said longitudinal lateral sides, a second bent segment adjoining said second seat segment and extending away from the other one of said longitudinal lateral sides, and a second stair segment adjoining said second bent segment and extending away from the other one said longitudinal lateral sides, said second seat segment and said second stair segment having a differential height therebetween.

8. The corrugated plate as claimed in claim 7, wherein said longitudinally opposite first and second ends of each of said curved rise portions are indented respectively from the imaginary planes respectively lying across said first and second arcuate ends of said arcuate part, said second bent segment having longitudinally opposite first and second ends respectively proximal to said first and second ends of said second seat segment, said second stair segment having longitudinally opposite first and second ends which are indented respectively from said first and second ends of said second bent segment and which are also indented respectively from said first and second ends of the other one of said curved rise portions.

9. The corrugated plate as claimed in claim 5, wherein said first seat segment has longitudinally opposite first and second ends, and two cutouts respectively formed in said longitudinally opposite first and second ends of said first seat segment.

10. The corrugated plate as claimed in claim 1, wherein each of said curved rise portions has an inner curved segment adjoining one of said first and second trough portions, and an outer flat segment adjoining said inner curved segment and extending away oppositely of said crest portion.

11. A corrugated plate assembly for ventilating and dissipating heat from a roof, comprising:

at least two corrugated plates, each of which has a crest portion, a first trough portion, a second trough portion, and two curve rise portions;

said crest portion including an arcuate part that is elongated along and curved around a longitudinal line, and that has first and second arcuate ends which are opposite to each other along the longitudinal line, two opposite longitudinal lateral sides connected between said first and second arcuate ends, and two indentations respectively indented from said first and second arcuate ends, wherein said arcuate part has a curvature that is asymmetric with respect to a central plane which is parallel to the longitudinal line and which intersects said arcuate part at a middle of said arcuate part;

said first trough portion extending longitudinally and connected to one of said longitudinal lateral sides;

said second trough portion extending longitudinally and connected to the other one of said longitudinal lateral sides;

said two curved rise portions extending longitudinally and respectively connected to said first and second trough portions oppositely of said crest portion;

said second arcuate ends of said at least two corrugated plates being aligned to face each other along the longitudinal line and being interconnected in such a manner that said indentations of said second arcuate ends are intersected each other and that said second arcuate ends overlap with each other on two opposite sides said indentations, wherein ventilation gaps are formed between overlapping parts of said second arcuate ends.

12. The corrugate plate assembly as claimed in claim 11, wherein said central plane passes through both of said indentations.

13. The corrugate plate assembly as claimed in claim 11, wherein:

said first trough portion has a first seat segment adjoining said one of said longitudinal lateral sides, a first bent segment bent from said first seat segment and extending away from said one of said longitudinal lateral sections, and a first stair segment adjoining said first bent segment and extending away from said one of said longitudinal lateral sections, said first seat segment and said first stair segment having a differential height therebetween;

said second trough portion has a second seat segment adjoining the other one of said longitudinal lateral sections, a second bent segment adjoining said second seat segment and extending away from the other one of said longitudinal lateral sections, and a second stair segment adjoining said second bent segment and extending away from the other one of said longitudinal lateral sections, said second seat segment and said second stair segment having a differential height therebetween;

each of said first and second seat segments has longitudinally opposite first and second ends which are partially and respectively flush with said first and second arcuate ends of said arcuate part;

said second ends of said first and second seat segments of one of said at least two corrugate plates respectively overlapping said second ends of said second and first seat segments of the other one of said at least two corrugate plates;

said second end of said first seat segment of each of said at least two corrugated plates having a cutout to receive said second end of said second seat segment of the other one of said at least two corrugated plates.

14. The corrugated plate assembly as claimed in claim 13, wherein:

for each of said at least two corrugated plates, each said curved rise portions has longitudinally opposite first and second ends which are indented respectively from imaginary planes respectively lying across said first and second arcuate ends of said arcuate part, said first bent segment having longitudinally opposite first and second ends respectively proximal to said first and second ends of said first seat segment, said first stair segment having longitudinally opposite first and second ends which are indented respectively from said first and second ends of said first bent segment and which are also indented respectively from said first and second ends of one of said curved rise portions; and for each of said at least two corrugated plates, said second bent segment has longitudinally opposite first and second ends respectively proximal to said first and second ends of said second seat segment, said second stair segment having longitudinally opposite first and second ends which are indented respectively from said first and second ends of said second bent segment and which are also indented respectively from said first and second ends of the other one of said curved se portions.

15. The corrugated plate assembly as claimed in claim 11, wherein said arcuate part further has a first half and a second half respectively disposed on two opposite sides of the central plane, said first half having a radius of curvature greater than that of said second half, and wherein said first trough portion is connected to said first half, and said second trough portion is connected to said second half.

* * * * *